US007294010B1

(12) United States Patent
Shaikh

(10) Patent No.: US 7,294,010 B1
(45) Date of Patent: Nov. 13, 2007

(54) CONNECTING ASSEMBLY WITH MAIN AND SECONDARY CONNECTORS

(75) Inventor: Mohammad Suhail Shaikh, Bangalore (IN)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 11/684,986

(22) Filed: Mar. 12, 2007

(51) Int. Cl.
*H01R 13/64* (2006.01)

(52) U.S. Cl. ..... 439/374; 439/310; 439/247

(58) Field of Classification Search ..... 439/247, 439/248, 374, 310
See application file for complete search history.

(56) References Cited

U.S. PATENT DOCUMENTS 4,906,197 A * 3/1990 Noll ..... 439/79
5,002,497 A 3/1991 Plocek et al.
5,167,520 A * 12/1992 Henry et al. ..... 439/266
5,551,430 A 9/1996 Blakeley et al.
5,552,959 A 9/1996 Penniman et al.
5,706,179 A * 1/1998 Palatov ..... 361/788
6,116,940 A * 9/2000 Bertens et al. ..... 439/357
6,362,622 B1 3/2002 Stauber et al.
6,390,841 B1 5/2002 Zaguskin
6,592,387 B2 * 7/2003 Komenda et al. ..... 439/247
6,648,662 B2 * 11/2003 Shinzou et al. ..... 439/310
6,660,950 B2 * 12/2003 Fonseca ..... 200/51 R
6,695,637 B1 * 2/2004 Liu ..... 439/377
6,926,551 B1 * 8/2005 Schulz et al. ..... 439/357
6,986,679 B1 * 1/2006 Aronson et al. ..... 439/374
7,059,882 B2 6/2006 Sugita et al.
7,150,644 B2 * 12/2006 Behl ..... 439/374
2006/0148293 A1 7/2006 Herring et al.

* cited by examiner

*Primary Examiner*—Tho D. Ta

(57) ABSTRACT

A connecting assembly with main and secondary connectors is disclosed herein. The connecting assembly comprises: a main connector provided with a secondary connector for operably engaging and disengaging the main connector. The secondary connector is provided with a first connecting part, electrically coupled to the main connector and a second connecting part, provided on a substantially fixed support. The first connecting part is provided in association with a guiding mechanism, so that it can move along the guiding mechanism to engage and disengage with the second connecting part. In an embodiment the second connecting part is provided with a floating mechanism to align its position with respect to the first connecting part during engagement. The connecting assembly can be disengaged by disconnecting the secondary connector by pulling a cable associated with the main connector.

20 Claims, 7 Drawing Sheets

CONNECTING ASSEMBLY WITH MAIN AND SECONDARY CONNECTORS

FIELD OF THE INVENTION

This invention relates generally to connectors, and more particularly to, a connecting assembly provided with a main connector and a secondary connector.

BACKGROUND OF THE INVENTION

Generally, a connector has male and female connecting parts for engaging and disengaging the connector. While connecting, the male and female parts will engage each other. While disconnecting, the male and female parts will disengage each other. In some cases, either the male or female part of the connector may not be visible or easily accessible to the operator for engaging and disengaging. In some cases, the force required for engagement and disengagement of a connector may be high. In situations where it is desirable to disengage the connector quickly, such as during an emergency, the inaccessibility and/or high level of force may make it infeasible to disengage the connector quickly.

In case of medical imaging apparatus, a connecting assembly is used for fixedly coupling a mobile patient positioner to a gantry at the time of medical imaging. In an emergency situation, the patient needs to be taken out of the gantry even while the apparatus is performing its operation. For removing the patient from the gantry, the positioner where the patient is lying has to be detached from the imaging apparatus. But during scanning, the positioner and the imaging apparatus are electrically connected via the connector. So first one needs to detach the electrical connection and this could be achieved by disengaging the connector quickly. But in many of the imaging apparatus, the female of the connector may be inside the imaging apparatus and may not be visible or accessible to the operator. Thus immediate disconnecting of the connector is difficult.

Some solutions used for emergency egress is disengaging the connector by pulling a cable attached to the connector. By doing so, the male part of the connector will get detached from the female part. But the pulling force, which needs to be applied to disengage the connector, is substantially high and this will reduce the life of the connector. In addition, re-engagaing the connector to resume the operation of the apparatus is difficult as the female connector is not visible or easily accessible to the operator. Also the female part of the connector is rigidly fixed inside the imaging apparatus. For engaging the connector, the male and female parts of the connector should be aligned with precision before engaging, the failure of which may result in destroying the connector or failing at the attempt of connecting.

In certain industrial and military applications it is necessary to have a connector assembly wherein the connector need to be engaged and disengaged very often. Engaging and disengaging the connectors very often may reduce the life of the connectors, which are often expensive. Also while disengaging the connector by pulling the cable associated with it, the connector may often fall down on the device to which it is connected and the life of the connector or the device may be reduced.

Thus there exists a need to provide a mechanism for protecting the connector from the adverse impacts of engaging and disengaging, and also a mechanism to engage and disengage the connector quickly and easily.

SUMMARY OF THE INVENTION

The above-mentioned shortcomings, disadvantages and problems are addressed herein which will be understood by reading and understanding the following specification.

The present invention provides a connecting assembly which may be used with medical imaging or other apparatus. The connecting assembly includes: (i) a block having a connecting part of a main connector provided on one side of the block and a first connecting part of a secondary connector provided on any side of the block, the first connecting part being electrically connected to the connecting part of the main connector; (ii) a support having a second connecting part of the secondary connector, the second connecting part being placed opposite to the first connecting part; and (iii) a guiding mechanism coupled to the block and the support, the bock being movable along the guiding mechanism and the support being substantially fixed to the guiding mechanism. The block is movable along the guiding mechanism for operationally engaging and disengaging the first and second connecting parts of the secondary connector.

In another embodiment, a medical imaging apparatus is provided. The medical imaging apparatus includes: (i) at least one gantry configured with an imaging component; (ii) at least one carrier assembly provided with a coil assembly, configured with a patient support component; and (iii) a connecting assembly for connecting the coil assembly to the gantry. The connecting assembly includes: (a) a main connector electrically connected to the coil assembly; (b) a secondary connector having a movable first connecting part electrically coupled to the main connector and a stationary second connecting part electrically coupled to the imaging component; and (c) a guiding mechanism configured for guiding the movement of the first connecting part to engage and disengage with the second connecting part. During an emergency egress the coil assembly is configured to be disconnected from the imaging component by pulling a cable connected to the connecting assembly to disengage the first and second connecting parts.

In yet another embodiment, a connecting assembly with a guided floating mechanism includes: (i) a moving block having a connecting part of a main connector provided on one side of the block and a movable first connecting part of a secondary connector provided on any side of the block; (ii) a support mounted with a floating plate using a floating mechanism, the floating plate being configured to incorporate a stationary second connecting part of the secondary connector; and (iii) a guiding mechanism having an elongated member coupled to the moving block at one end and the support at the other end. The floating mechanism is configured to provide axial and radial float to the stationary second connecting part while aligning with the moving first connecting part.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

In various embodiments, a connecting assembly with an easy engagement and disengagement mechanism is provided. The connecting assembly is provided with a secondary connector, which operably performs the functions of the main connector. The secondary connector is easily engageable and disengageable compared to the main connector. Generally during emergency the connector is disengaged by pulling a cable wire attached to the main connector, thereby disconnecting the secondary connector.

In an embodiment the invention provides a connecting assembly with a guided floating mechanism. This allows the user to disengage the connector by disconnecting a secondary connector and for re-engaging the secondary connector a floating mechanism is provided. The floating mechanism helps in aligning the connecting parts of the secondary connector with respect to each other.

In an embodiment the invention disclosed increases the life of the connector by using a secondary connector for disengaging and engaging the main connector and by a floating mechanism for aligning the connecting parts.

While the present technique is described herein with reference to medical imaging applications, it should be noted that the invention is not limited to this or any particular application or environment. Rather, the technique may be employed in a range of electrical and/or mechanical applications where at least one of the connecting parts of the connector is not accessible to the operator and/or where a quick disconnection of the connector is required during emergency. For example, in electronic equipments, such as computers or servers, two circuit boards may need to be electrically connected via electrical connectors that are mounted in a fixed position to their respective circuit boards. One board may be installed within the housing and the other board slid into position such that its connector blindly mates with the connector of the other board. In this situation one of the connecting part can be provided with a floating mechanism to align the mating of the connectors.

Figure 1:
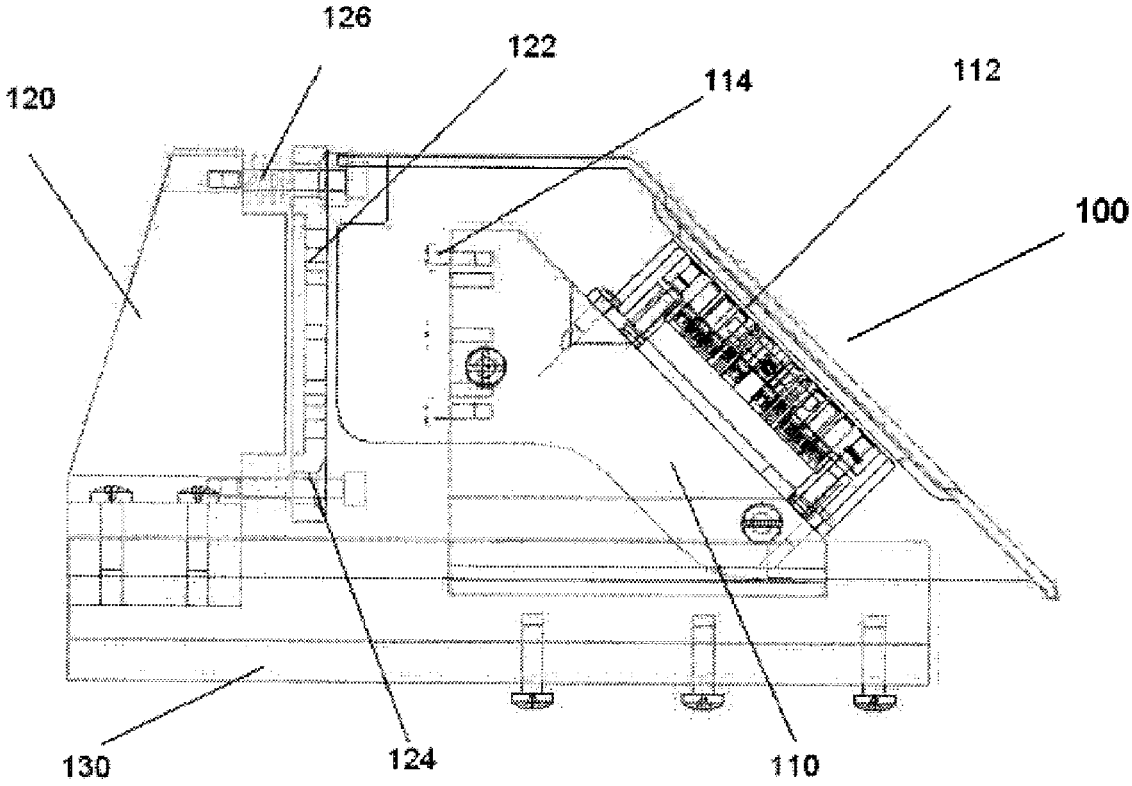
FIG. 1 is a side view of a connecting assembly including a guiding mechanism as described in an embodiment of the invention.

FIG. 1 is side view of a connecting assembly having a guiding mechanism as described in an embodiment of the invention. The connecting assembly 100 is explained with reference to a medical imaging apparatus and a patient positioner. However this is only for explanation purpose and could be extended to different connectors. Examples of a medical imaging apparatus include a Magnetic Resonance Imaging (MRI) apparatus, a Computed Tomography (CT) scanner, a vascular imaging apparatus, etc. One example of a patient positioner includes a trolley or a patient table configured for carrying a patient in substantially horizontal posture for medical imaging.

In an embodiment, the connecting assembly 100 includes a block 110, a support 120, and a guiding mechanism 130. The bock 110 includes a connecting part of a main connector 112. Generally the connecting part of the main connector 112 is used for engaging and disengaging the connecting assembly with the imaging apparatus (not shown). In an embodiment of the invention a secondary connector is provided for operatively engaging and disengaging the connecting assembly to the imaging apparatus. The secondary connector has a first connecting part 114 and a second connecting part 122. The first connecting part 114 is provided in the block 110. The first connecting part 114 is electrically connected to the main connector 112 and could be placed on any side of the block 110, though in FIG. 1 it is shown on a side of block 110 generally opposite from the connecting part of main connector 112. Instead of the main connector 112, the first connecting part 114 will be operational for engagement and disengagement.

In an embodiment the block 110 is provided with a tapering section for accommodating the connecting part of main connector 112 and a linear section for incorporating the first part of the secondary connector 114. The block 110 is provided with grooves or projections for allowing the movement of the block 110 through a track of the guiding mechanism 130. However the block 110 could be any structure which can accommodate the connecting part of main connector 112 as well as the first connecting part of the secondary connector 114 and should be capable of moving for engaging and disengaging the connecting assembly by moving first connecting part 114 and second connecting part 122 toward each other or away from each other. The design, size and shape of block 110 may depend on the application of the invention. The connecting part of main connector 112 is, in one embodiment, the female part of the main connector that is adapted to receive the male part of the main connector attached to a cable (not shown). In another embodiment, the connecting part of main connector 112 is the male part of the main connector that is adapted to mate with the female part of the main connector attached to a cable (not shown). The secondary connector allows the connection to be engaged or disengaged without the need to engage or disengage the main connector.

The support 120 is provided for incorporating the second connecting part 122 of the secondary connector. The second connecting part 122 is provided opposite to and in alignment with the first connecting part 114 so these parts mate when brought into contact by movement of block 110 along guiding mechanism 130. The support 120 could be any structure accommodating the second connecting part 122 and could be substantially fixed to one end of the guiding mechanism 130.

In an embodiment the second connecting part 122 is provided on a floating plate 124. The floating plate 124 is connected to the support 120 using a floating mechanism 126. The floating mechanism 126 associated with the floating plate 124 allows the second connecting part 122 of the secondary connector to be floating and this helps in aligning the position of the second connecting part 122 with respect to the first connecting part 114 when block 110 is moved towards support 120.

The guiding mechanism 130 is provided for the movement of the block 110 for engaging and disengaging the connector. Also the guiding mechanism 130 accommodates the support 120. In one embodiment, the guiding mechanism 130 is an elongated member provided with grooves or projections. In an embodiment a rail or track with "T" or "I" section is provided as a guiding mechanism. However the guiding mechanism need not be limited to this. The guiding mechanism can be any guide that allows the block to move along for engaging and disengaging the connecting assembly.

Figure 2:
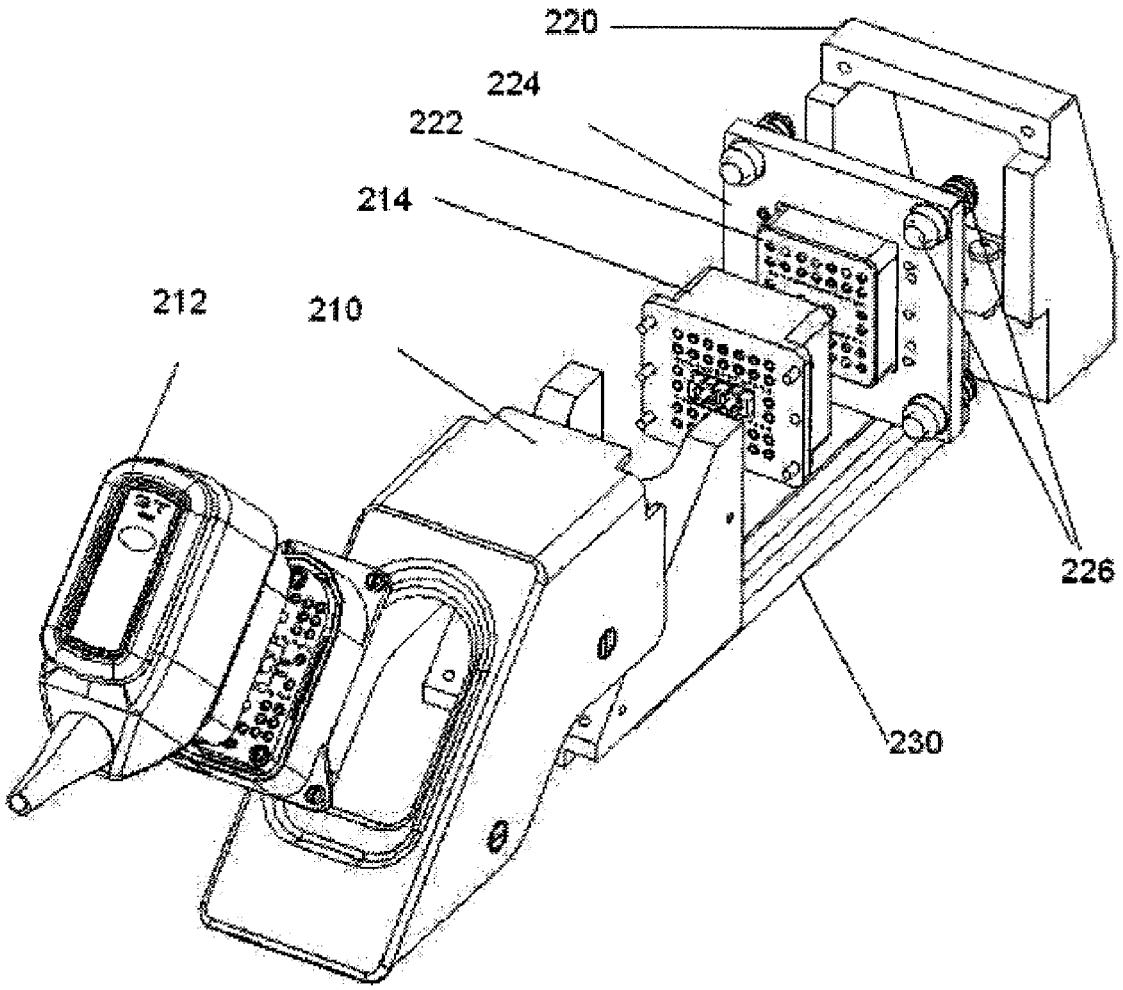
FIG. 2 is a schematic diagram of a connecting assembly as described in an embodiment of the invention.

FIG. 2 is a schematic diagram of a connecting assembly as described in an embodiment of the invention. The block 210 is provided with a connecting part of the main connector 212 and a first connecting part 214 of the secondary connector. The block 210 shown has a tapering section on one face and linear section on the other face. The tapering section incorporates the connecting part of the main connector 212, which in the embodiment of FIG. 2 is the female part of the main connector 212, which mates with the male part of the main connector when the main connector 212 is connected. The first part of secondary connector 214 can be provided on the other side of the same block or can have be provided as a separate attachment to the block incorporating the first connecting part of the secondary connector. It should be noted that the first connecting part of the secondary connector may be provided on any side of the block. However the second connecting part should be located opposite to the first connecting part for engaging or disengaging the connector. In FIG. 2, the first connecting part 214 of the secondary connector is generally opposite the main connector 212 such that, when the cable attached to the main connector is pulled with a force sufficient to overcome the holding force of the secondary connector, the secondary connector is disconnected. A support 220 is provided for incorporating the second connecting part 222 of the secondary connector. The second connecting part 222 is mounted on a floating plate 224 using a floating mechanism 226. The floating mechanism provides axial as well as linear float to the second connecting part 222. The block 210 and the support 220 are mounted on a guiding mechanism 230. The support 220 is attached to an end of the guiding mechanism 230 and the block 210 is configured to move along the guiding mechanism for engaging and disengaging the connecting assembly. The block 210 is provided with grooves or projections and corresponding to the projections or grooves are provided on the guiding mechanism as well. This embodiment is only for illustrative purpose and the structural imitations mentioned are not critical for the performance of the invention.

In an embodiment the connector may be an electrical or mechanical connector. The main connector and the secondary connector in an example may be coil connectors, more specifically radio frequency connectors.

Figure 3:
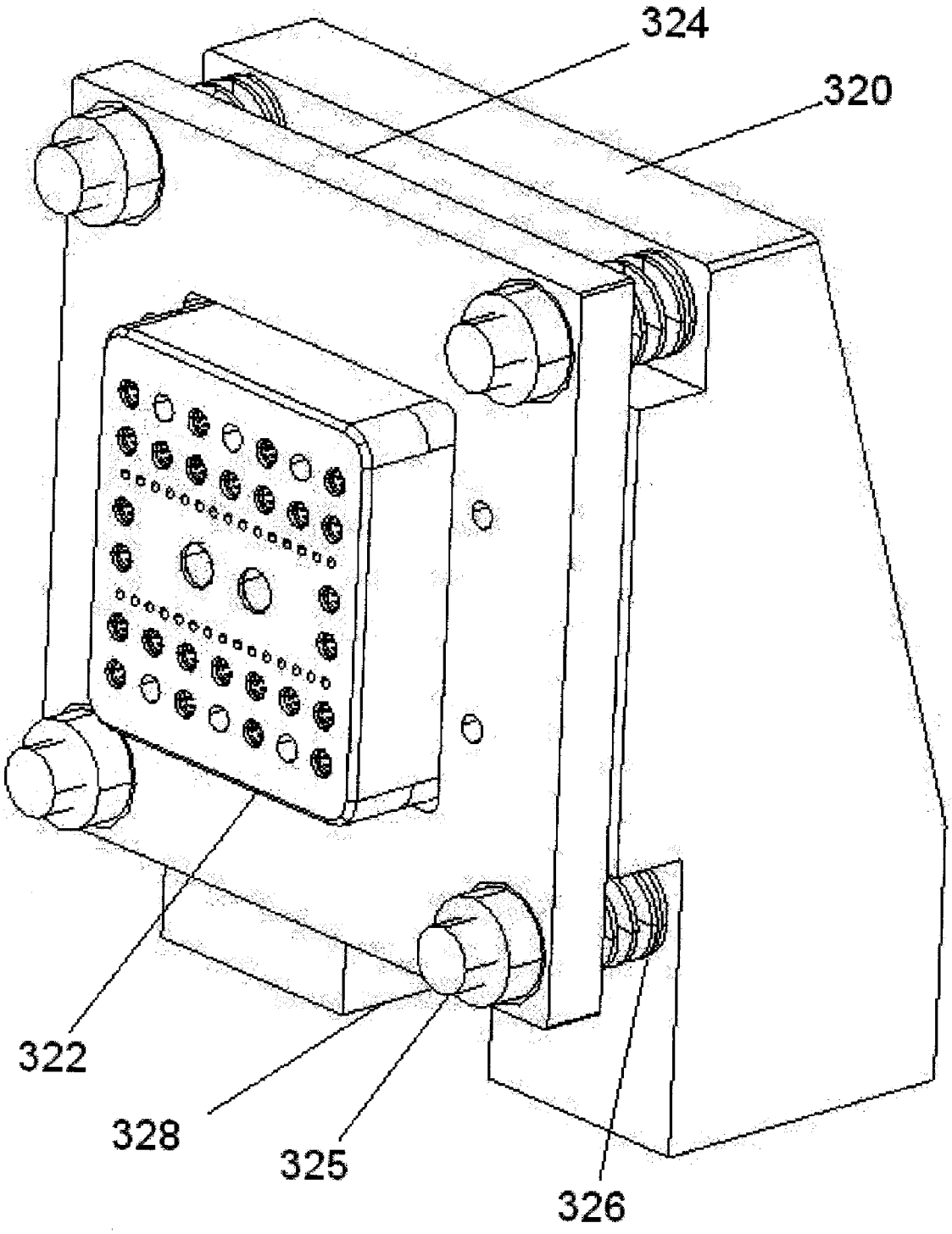
FIG. 3 is a schematic diagram of a floating mechanism as described in an embodiment of the invention.

FIG. 3 is a detailed view of a floating mechanism as described in an embodiment of the invention. The mechanical mating/connection of two bodies, such as a first connecting part and a second connecting part of electrical connectors, generally requires that the two connecting parts to be aligned within given positional tolerances. Any misalignment between the two connecting parts may make the attempted mating difficult or may even damage any of the connecting parts. In an embodiment the connecting assembly is provided with a floating mechanism capable of alignment of the second connecting part in multiple degrees of freedom to enable the mating of the first and second connecting part of a connector. The movement permitted includes linear and rotational movement in up to six degrees of freedom depending on the configuration of the invention used. The floating mechanism cooperates with the guiding mechanism shown in FIG. 1 or FIG. 2 to align the connector during engagement, even in situations where the user is unable to see or manually adjust the positions of the mating parts.

A secondary connector with a first connecting part and a second connecting part is provided for operatively engaging and disengaging the main connector, which allows the connecting assembly to perform the functionality of connecting and disconnecting, even while the main connector itself remains connected. The second connecting part of the secondary connector 322 may be substantially fixed to a support 320, which may be located within the apparatus wherein the connection is involved. In an embodiment the second part 322 is mounted on a floating plate 324 and is connected to the support 320 using a floating mechanism 325, 326. The floating plate 324 is provided with one or more washers 325 on at least one corner of the floating plate 324. The washers 325 are free to rotate in the corner of the floating plate 324 giving freedom of rotation in all direction and hence giving a radial float to the floating plate 324. In an example, spherical washers are provided. The floating mechanism also includes a plurality of springs 326 provided on the floating plate 324 for attaching the floating plate 324 to the support 320. The springs 326 provide axial float to the floating plate. This gives linear movement freedom to the floating plate 324 to align the second connecting part 322 with respect to the first connecting part. Hence by using the axial and rotational floating mechanism, the floating plate aligns the second connecting part to the first connecting part during engagement of the connecting assembly.

In an embodiment the support 320 is fixed to a guiding mechanism, such as guiding mechanism 130 in FIG. 1 or guiding mechanism 230 in FIG. 2. Generally the support 320 is attached to an end of the guiding mechanism, which is located opposite to the end where the first connecting part of the connector is located. The support 320 is provided with groove or projection 328 for accommodating the guiding mechanism.

In an embodiment the support 320 need not be attached to the guiding mechanism. But rather the support 320 could be placed adjacent to the guiding mechanism, so that while engaging the first connecting part, which is guided through the guiding mechanism and the second connecting part attached to the support can be engaged with precision.

Figure 4:
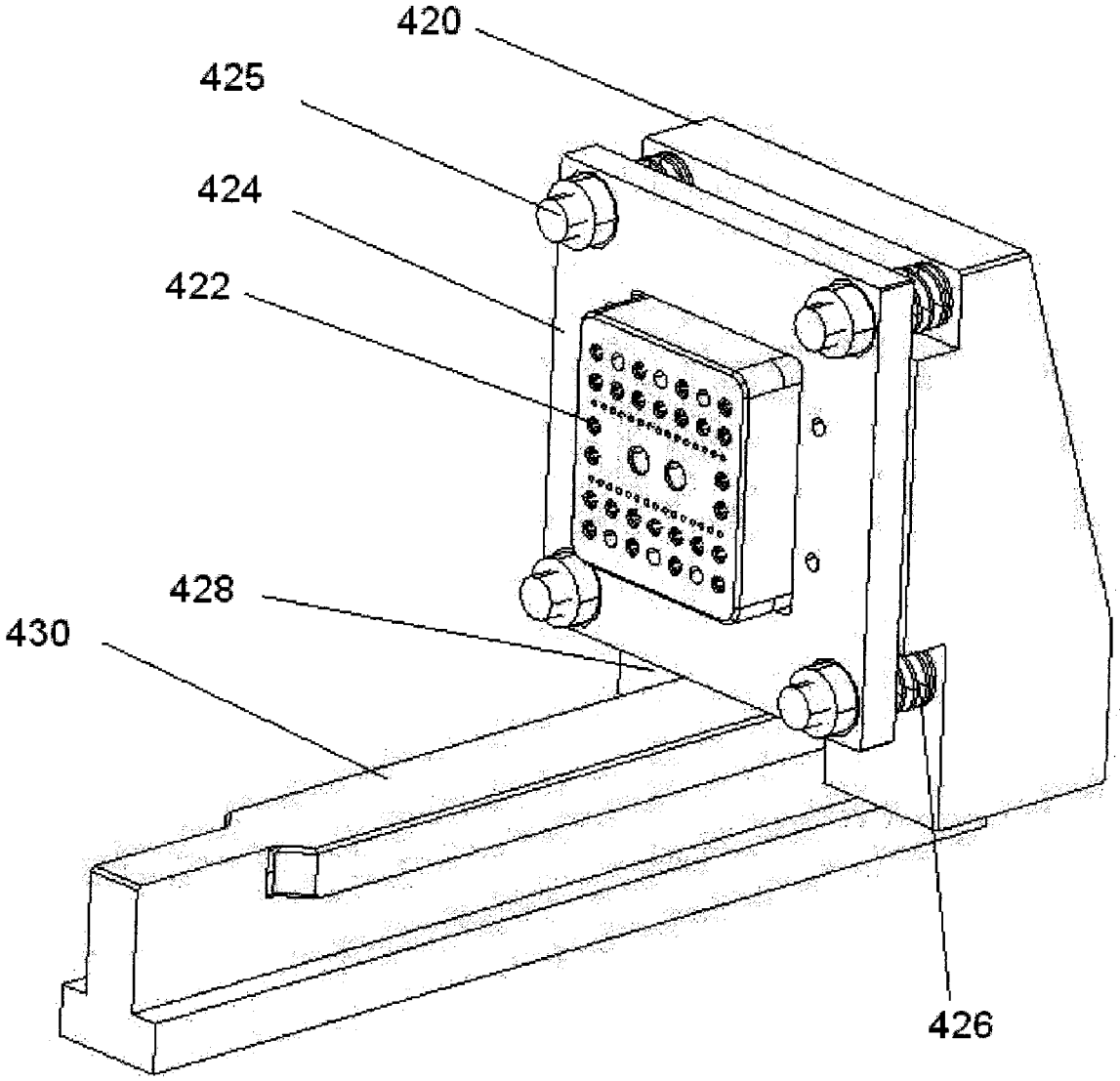
FIG. 4 is a schematic diagram of floating mechanism along with the guiding mechanism as described in an embodiment of the invention.

FIG. 4 is a detailed view of a floating mechanism along with the guiding mechanism as described in an embodiment of the invention. Constructional as well as functional features of the floating mechanism are explained in reference to FIG. 3. The secondary connector with a first connecting part and a second connecting part is provided for operatively engaging and disengaging the main connector. The second connecting part of the secondary connector 422 may be substantially fixed to a support 420, which may be located within the apparatus wherein the connection is involved. In an embodiment the second part 422 is mounted on a floating plate 424 and is connected to the support 420 using a floating mechanism. The floating plate 424 is further provided with one or more washers 425 on at least one corner of the floating plate 424. Each washer 425 is free to rotate in the corner giving freedom of rotation to the floating plate 424 in all direction and thus giving a radial float to the floating plate 424. The floating mechanism also includes a plurality of springs 426 provided on the floating plate 424 for attaching the floating plate 424 to the support 420. The springs 426 provide axial float to the floating plate 424. This give linear movement freedom to the floating plate 424 to align the second connecting part 422 with respect to the first connecting part. Hence by using the axial and rotational float, the floating plate 424 aligns the second connecting part 422 to the first connecting part during engagement of the connecting assembly.

In an embodiment the support 420 is fixed to a guiding mechanism 430. Generally the support 420 is attached to an end of the guiding mechanism 430, which is located at an opposite end where the first connecting part of the connector is located. In an embodiment shown the guiding mechanism 430 is an elongated member provided with grooves or projections. The guiding mechanism 430 is provided with groove or projections on at least a part of the guiding mechanism 430 for providing the movement of the first connecting part. However the guiding portion where the support is attached need not have grooves or projections. In an example a rail or track with "T" or "I" section is provided as a guiding mechanism. However the guiding mechanism need not be limited to this. The guiding mechanism can be any guide that allows the block to move along for engaging and disengaging the connecting assembly. The size, shape, design etc of the support and the guiding mechanism may differ based on the usage of the invention.

Figure 5A:
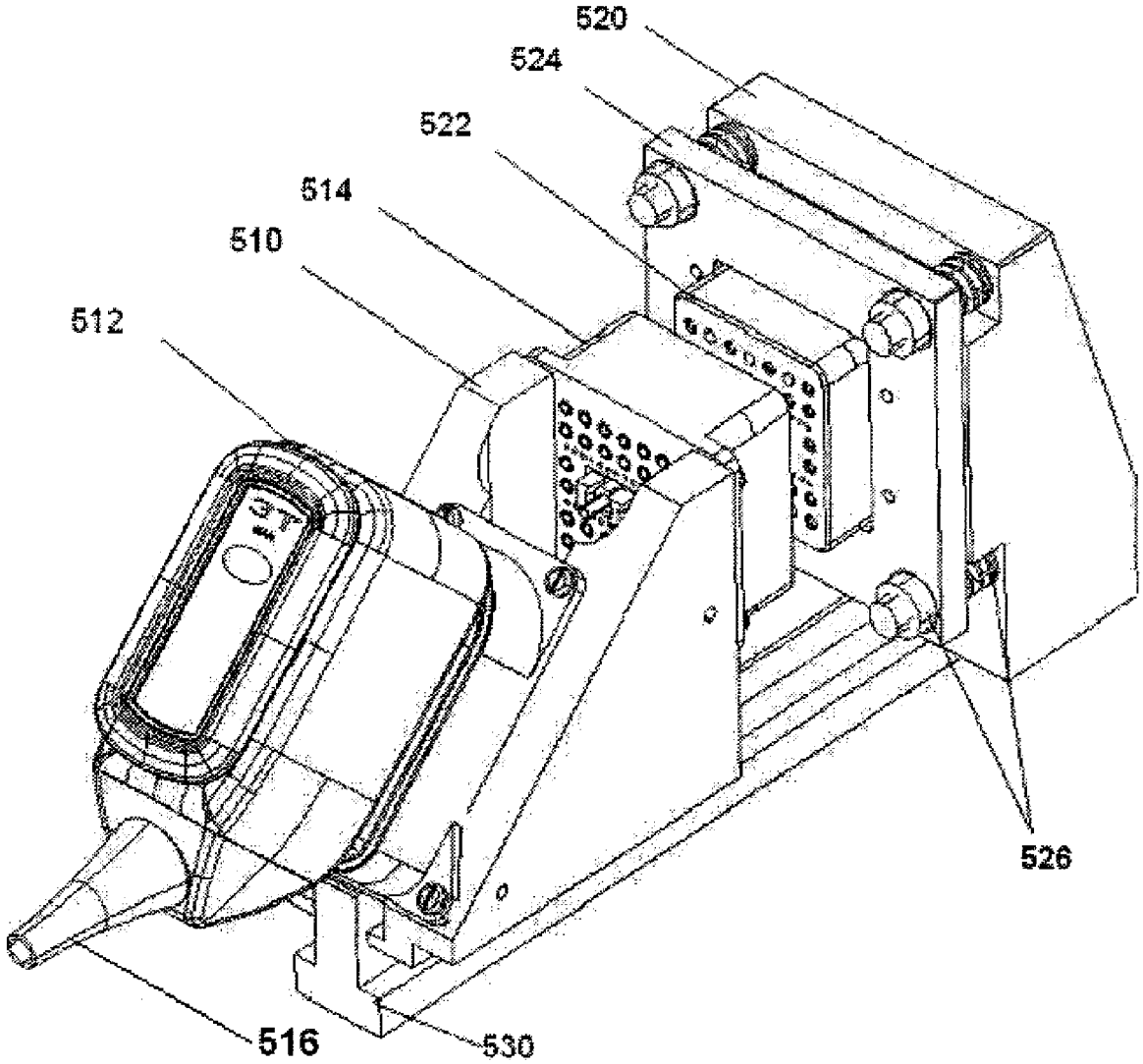
FIGS. 5A and 5B are schematic diagrams of a connecting assembly in disengaged and engaged position, respectively, as disclosed in an embodiment of the invention.
Figure 5B:
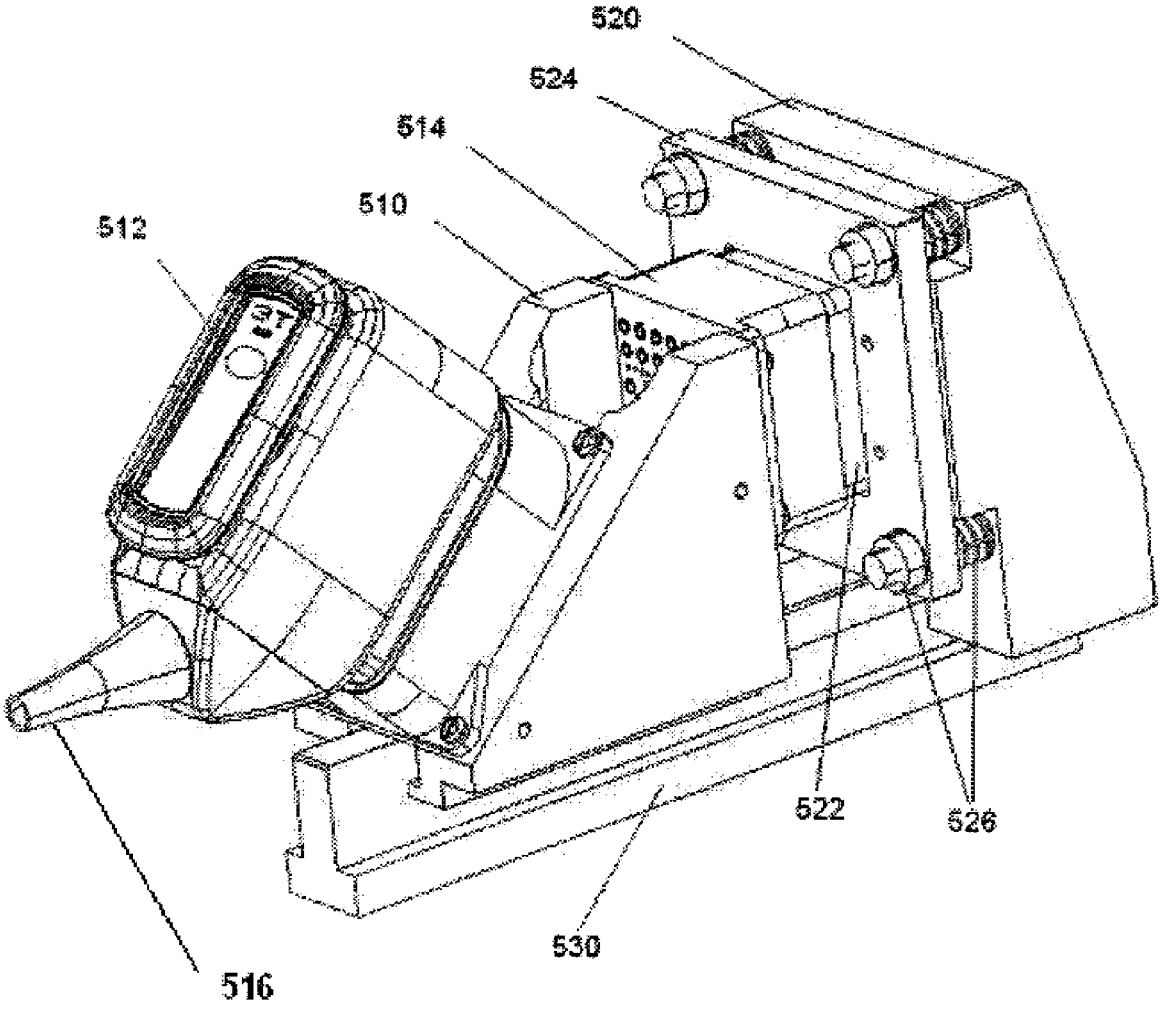

FIGS. 5A and 5B show a schematic diagram of a connecting assembly in disengaged and engaged position, respectively, as disclosed in an embodiment of the invention. The constructional and functional aspects of the connecting assembly are explained in the earlier part of the specification. One skilled in the art should understand that the structural design of the embodiment shown is only for illustrative purpose and can be modified as per the requirements of the particular application. In an embodiment, the connecting assembly is provided with a block 510, a support 520 and a guiding mechanism 530 coupled to both the block 510 and the support 520. A secondary connector is provided along with a main connector for performing the operation of the main connector. The block 510 incorporates a connecting part of a main connector 512 and a first connecting part of the secondary connector 514. A support 520 is provided to incorporate a second connecting part 522 of the secondary connector.

FIG. 5A shows the connecting assembly in a disengaged position. For engaging, the block 510 carrying the connecting part of the main connector 512 and the first part of the secondary connector 514 is moved along the guiding mechanism 530. The guiding mechanism 530 shown is provided with grooves to accommodate the block 510 and corresponding projections are provided on block 510. For engaging the connecting assembly, an operator may push the block 510 towards the support 520. The block 510 moves along the guiding mechanism 530. As and when the first connecting part 514 approaches the second connecting part 522, the floating mechanism 526 provided with the second connecting part allows the second connecting part 522 to align its position with respect to the first connecting part 514, so that the mating can be done precisely. As described earlier the second connecting part is mounted on a floating plate 524 using the floating mechanism 526 and aligns the position of the second connecting part 522 with respect to first connecting part 514 while engaging. In an example the spherical washers provided on the corners of the floating plate 524 gives a rotational movement to the floating plate 524 within a small range and a plurality of springs attached to the floating plate 524 and the support 520 provides a linear alignment of the second connecting part 522 in a defined range. The floating mechanism 526 provides the second connecting part 522 an axial and radial float allowing the movement of the floating-plate 524 in six degrees in a limited range. Thus the operator pushes the first connecting part 514 of the secondary connector to the second connecting part 522 of the secondary connector and the connecting assembly is engaged. FIG. 5B shows the connector in an engaged position.

For disengaging, especially during emergency egress, the connecting assembly may be disengaged by pulling a cable 516 provided on the main connector 512. By applying the pulling force the block carrying the first connecting part of the secondary connector will move away from the second part and will get disconnected from the second connecting part. However it should be noted that the pulling force applied and the secondary connector is selected such that by pulling the cable, the block will move backward and will disengage and disconnect the connecting assembly, keeping the main connector in its engaged position. The force applied for pulling or disconnecting is sufficient to disengage the secondary connector and this operationally disconnects the main connector from the apparatus. In an example the maximum load that can be pulled by this way is 17-20 lbs. The pulling force needed to disengage the secondary connector is less than the force needed to disconnect the main connector. However for disengaging the connecting assembly the block need not be removed completely from the guiding mechanism, but it should be sufficient that the first and second connecting part are no longer in contact. After being disengaged, the connecting assembly can be easily re-engaged as described in relation to FIG. 5A. Thus, the connecting assembly can be easily and quickly engaged and re-engaged, even as the main connector remains engaged.

Figure 6:
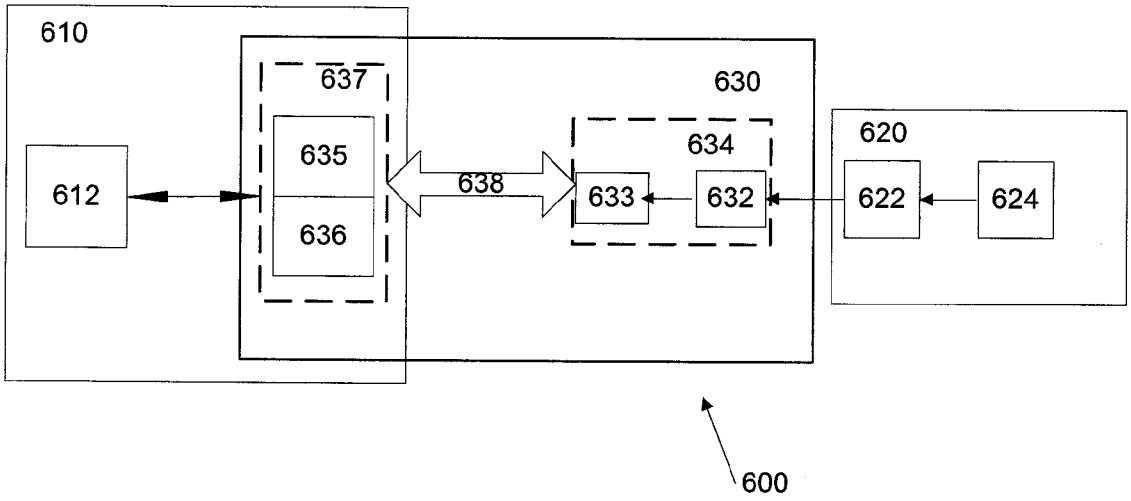
FIG. 6 is a block diagram of a medical imaging apparatus using a connecting assembly as described in an embodiment of the invention.

FIG. 6 is a block diagram of a medical imaging apparatus using a connecting assembly as described in an embodiment of the invention. The medical imaging apparatus 600 is provided with an imager 610, a carrier assembly 620 and a connecting assembly 630 to connect the imager 610 to the carrier assembly 620. The imager 610 is provided with a gantry 612 having an imaging component. Examples of a medical imaging apparatus include a Magnetic Resonance Imaging (MRI) apparatus, a Computed Tomography (CT) scanner, a vascular imaging apparatus, etc. The carrier assembly 620 includes a patient support component 622 and the examples of a patient support component includes a trolley or a patient table configured for carrying a patient in substantially horizontal posture for medical imaging. The carrier assembly 620 is provided with a coil assembly 624, which acts as an interface between the imager 610 and the carrier assembly 620. The coil assembly 624 is connected to a main connector 632, which will be a part of the connecting assembly 630 and electrically connects the carrier assembly 620 to the imager 610. A secondary connector is provided to perform the operation of the main connector. The first part of the secondary connector 633 is electrically coupled to the main connector 632. In an example the first part of the secondary connector and a connecting part of the main connector may be located in a block 634. The second part 635 of the secondary connector may be fixed inside the imager 610, may be provided with the gantry 612. The second part 635 is provided in association with a floating mechanism 636, which provides radial as well as linear float to the second connecting part, while engaging with the first connecting part 633. The second part along with the floating mechanism may be provided as a support 637, which could be provided in electrical coupling with the gantry 612. A guiding mechanism 638 is provided for connecting the block 634 and support 637. The block 634 is configured for moving along the guiding mechanism 638 for engaging and disengaging the coil assembly to the gantry. For engaging the coil assembly 624 to the imager 610, the block 634 is moved along the guiding mechanism 638 towards the second connecting part 635. The second connecting part 635 using the floating mechanism 636 adjusts the position of the second connecting part 635 with respect to the first connecting part 633. While disengaging the block 634 is pulled out using a cable attached to the main connector 632. During engagement the second connecting part is aligned with respect to the first connecting part using the floating mechanism. In an example the floating mechanism may provide radial as well as linear float to the second connecting part.

The medical imaging apparatus is one of the possible usages of the connecting assembly described herein. However the usage of the connecting assembly can be extended to any other electrical radio frequency or mechanical connectors.

Some of the advantages of the invention include providing a simple mechanism for easy engagement and disengagement of a connector. The usage of a secondary connector avoids the direct connecting and disconnecting of the main connector, thereby extending the life span of the main connector. Also the floating mechanism provided, gives the flexibility of easy mating of the connector, even when at least one of the connecting parts of the connector is not accessible to the operator. This will reduce the human interventions in connecting and disconnecting the connector. The floating mechanism disclosed in embodiments of the invention is simple and fairly inexpensive. The axial float mechanism ensures the full engagement of the connecting parts and the rotational float provides rotational freedom in aligning the connecting parts. However it should be noted that the float can be achieved by using different float mechanisms. Further the block and the support can be mounted on a guiding mechanism allowing the connecting assembly to be constructed or assemble as a single unit.

Thus various embodiments of the invention describe a connecting assembly with secondary connector for engaging and disengaging the main connector. Also in an embodiment a connecting assembly with a floating mechanism provided for aligning the position of the connecting parts of the connector with respect to each other is disclosed.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

I claim:

1. A connecting assembly, comprising:

(i) a block having a connecting part of a main connector provided on one side of the block and a first connecting part of a secondary connector provided on any side of the block, the first connecting part being electrically connected to the connecting part of the main connector;

(ii) a support having a second connecting part of the secondary connector, the second connecting part being placed opposite to the first connecting part; and (iii) a guiding mechanism coupled to the block and the support, the block being movable along the guiding mechanism and the support being substantially fixed to the guiding mechanism;

wherein the block is movable along the guiding mechanism for operationally engaging and disengaging the first and second connecting parts of the secondary connector, and wherein the main connector and the secondary connector are configured such that a secondary pulling force needed to disconnect the secondary connector is less than a main pulling force needed to disconnect the main connector.

2. A connecting assembly as in claim 1, wherein the block is configured to be moved away from the support when a force is applied to the main connector in a direction away from the support.

3. A connecting assembly as in claim 1, wherein the block, the support and the guiding mechanism are arranged as a single unit.

4. A connecting assembly as in claim 1, wherein the secondary connector is an electrical or mechanical connector.

5. A connecting assembly as in claim 1, wherein the main connector and the secondary connector are coil connectors.

6. A connecting assembly as in claim 1, wherein the coil connectors are radio frequency connectors.

7. A connecting assembly as in claim 1, wherein the block is provided with grooves or projections configured for moving along a track of the guiding mechanism.

8. A connecting assembly as in claim 7, wherein the guiding mechanism is an elongated member provided with grooves or projections for guiding the movement of the block.

9. A connecting assembly, comprising:

(i) a block having a connecting part of a main connector provided on one side of the block and a first connecting part of a secondary connector provided on any side of the block the first connecting part being electrically connected to the connecting part of the main connector;

(ii) a support having a second connecting part of the secondary connector, the second connecting part being placed opposite to the first connecting part; and (iii) a guiding mechanism coupled to the block and the support, the block being movable along the guiding mechanism and the support being substantially fixed to the guiding mechanism;

wherein the block is movable along the guiding mechanism for operationally engaging and disengaging the first and second connecting parts of the secondary connector, and wherein the support further comprises a floating plate mounted on the support by a floating mechanism, the floating plate being configured for carrying the second connecting part.

10. A connecting assembly as in claim 9, wherein the floating plate and the floating mechanism are configured for aligning the second connecting part of the secondary connector with respect to the first connecting part while engaging.

11. A medical imaging apparatus, comprising:

(i) at least one gantry configured with an imaging component;

(ii) at least one carrier assembly provided with a coil assembly, configured with a patient support component; and (iii) a connecting assembly for connecting the coil assembly to the imaging component; said connecting assembly comprising:

(a) a main connector electrically connected to the coil assembly;

(b) a secondary connector having a movable first connecting part electrically coupled to the main connector and a stationary second connecting part electrically coupled to the imaging component; and (c) a guiding mechanism configured for guiding the movement of the first connecting part to engage and disengage with the second connecting part;

wherein during an emergency egress the coil assembly is configured to be disconnected from the imaging component by pulling a cable connected to the connecting assembly to disengage the first and second connecting parts.

12. A medical imaging apparatus as in claim 11, wherein the guiding mechanism is configured to align the first connecting part with the second connecting part when engaging the secondary connector.

13. A medical imaging apparatus as in claim 11, wherein the second connecting part of the secondary connector is provided on a support.

14. A medical imaging apparatus as in claim 13, further comprising a floating plate mounted on the support through a floating mechanism.

15. A medical imaging apparatus as in claim 14, wherein the floating mechanism is configured for aligning the second connecting part with the first connecting part during engagement of the secondary connector.

16. A medical imaging apparatus as in claim 15, wherein the floating mechanism comprises an axial float including a plurality of springs provided between the floating plate and the support and a radial float including at least one washer provided on at least one corner of the floating plate.

17. A connecting assembly with a guided floating mechanism comprising:

(i) a moving block having a connecting part of a main connector provided on one side of the block and a movable first connecting part of a secondary connector provided on any side of the block;

(ii) a support mounted with a floating plate using a floating mechanism, the floating plate being configured to incorporate a stationary second connecting part of the secondary connector; and (iii) a guiding mechanism having an elongated member coupled to the moving block at one end and the support at the other end;

wherein the floating mechanism is configured to provide axial and radial float to the stationary second connecting part while aligning with the movable first connecting part.

18. A connecting assembly as in claim 17, wherein the first connecting part of the secondary connector is configured to move along the guiding mechanism for operationally connecting and disconnecting the main connector to the support through the secondary connector.

19. A connecting assembly as in claim 17, wherein the floating mechanism comprises an axial floating mechanism including a plurality of springs provided between the floating plate and the support and a radial floating mechanism including a plurality of spherical washers provided on the floating plate.

20. A connecting assembly as in claim 17, wherein the first connecting part is a male and the second connecting part is a female of a radio frequency connector.

* * * * *